United States Patent [19]

Blanco

[11] 4,267,788

[45] May 19, 1981

[54] SELF-STABILIZED ELEVATOR-FLOAT FOR DRYDOCKING OR FLOATING ANY TYPE OF VESSEL

[76] Inventor: Manuel G. Blanco, c/o Hermanos Paquet, No. 2, 4°, Gijon, Spain

[21] Appl. No.: 864,525

[22] Filed: Dec. 27, 1977

[30] Foreign Application Priority Data

Sep. 14, 1977 [ES] Spain ..... 462.374

[51] Int. Cl.[3] ..... B63C 1/02

[52] U.S. Cl. ..... 114/45; 114/125; 114/264; 405/4

[58] Field of Search ..... 114/125, 44, 45, 46, 114/48; 61/64, 65; 212/15; 405/4–7

[56] References Cited

U.S. PATENT DOCUMENTS

| | | | |
|---|---|---|---|
| 256,608 | 4/1882 | Watts | 114/48 |
| 3,204,780 | 9/1965 | Holt | 212/15 |
| 3,276,211 | 10/1966 | Drake | 114/48 |
| 3,537,412 | 11/1970 | Henderson | 114/125 |
| 4,015,554 | 4/1977 | Chow | 114/125 |

*Primary Examiner*—Trygve M. Blix
*Assistant Examiner*—D. W. Keen
*Attorney, Agent, or Firm*—Darby & Darby

[57] ABSTRACT

A self stabilizing elevator float having a float body divided into a series of ballast tanks which are bailed or flooded to raise or lower the float body. A first pair of vertically displaceable towers are arranged at one end of the float. A second pair of towers at the opposite end of the float are displaced sufficiently transverse from the float so that the first and second pair of towers imparts longitudinal and transverse stability to the float.

8 Claims, 12 Drawing Figures

SELF-STABILIZED ELEVATOR-FLOAT FOR DRYDOCKING OR FLOATING ANY TYPE OF VESSEL

The present invention relates to a structure for a self-stabilized elevator-float having a simplified system for hoisting and drydocking vessels and vice versa. The structure facilitates the transfer of vessels in any direction and from any point of the dock.

The elevator technique is relatively recent and until now has been used to lift vessels of somewhat smaller size. In the elevator technique a platform is lowered to a given sea level, the vessel is placed on top of the platform, and the vessel and platform are then lifted together to the level of the shipyard. The vessel is then transferred by means of trucks with longitudinal and transverse wheels until it is clear of the platform, where the separations are made. Flotation of the vessel is performed inversely.

Heretofore, platforms were driven by mechanical hoisting elements, either by synchronized electric winches (syncrolift system), by hydraulic motors, or by support feet systems and hydraulically operated racks.

Except for techniques peculiar to naval engineering, all current platform systems are based on techniques applicable to any field of industrial activity. Extrapolation has been carried out on industrial techniques and at the present time, the industry is faced with the problem of hoisting 35,000 ton vessels by means of electric winches. This involves extremely costly mechanical and electrical equipment, incorrect calculations of the resistant structure of the platform, enormous loads on the dock walls, little maneuvering flexibility, and hoisting and lowering rigidity. In addition, problems which can be decisive in the normal running of a shipyard building large vessels include the possibility of important breakdowns in such complex and costly equipment and the limitation of vessels to lengthwise movement because of the system of winches placed in the side wharfs. This limitation necessitates long runs both in the longitudinal and transverse directions. The length of a drydocking or floating operation for large vessels, where the travelling speed is necessarily slow, can be a determining factor preventing adequate performance of the shipyard.

The present invention overcomes the gap in current techniques for floating and drydocking medium and large sized vessels. The solution of these problems is focussed on techniques currently used in shipbuilding. Furthermore, aware that innovations of this type could encounter resistance in certain sectors, both professional and conventional, it has been endeavored to offer simple solutions. The success of the system lies in the harmonious combination of knowledge and techniques which are used by naval engineering professionals.

Objects of the present invention include:

(1) A simple system, without technical complexities.
(2) Low price.
(3) Self-docking.
(4) Drydocking vessels with big differences in draught.
(5) Saving in the time of moving vessels.
(6) Reduction in the shipyard area.
(7) Saving in the civil works costs of the shipyard.

As an indication of the cost savings achieved through the present system, for an installation with a lifting power of 35,000 tons (equal to lightweight) we know that the conventional "syncrolift" costs approximately one thousand five hundred million pesetas, whereas with a float according to the present invention, the cost will range between approximately seven and nine hundred million pesetas.

In order to further understand the present invention, reference is made to the annexed drawings in which.

Figure 1:
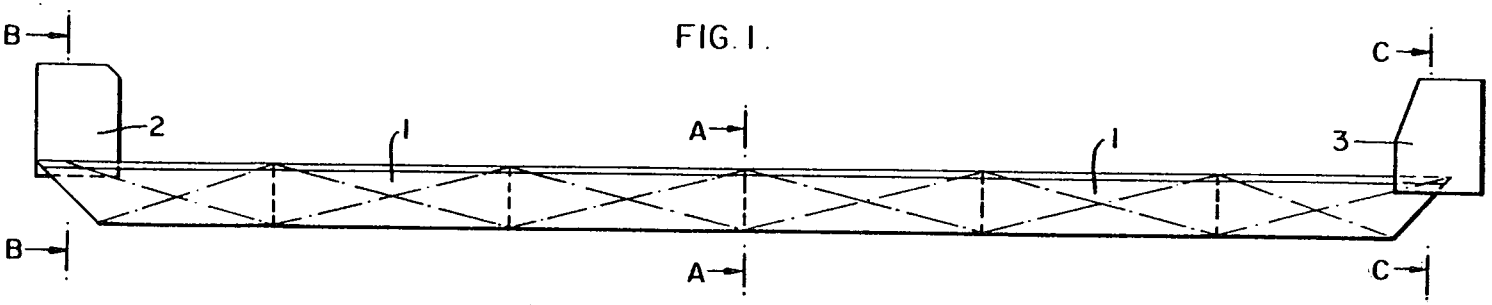
FIG. 1 shows a side elevation view of the float with its stabilizer towers.
Figure 4:
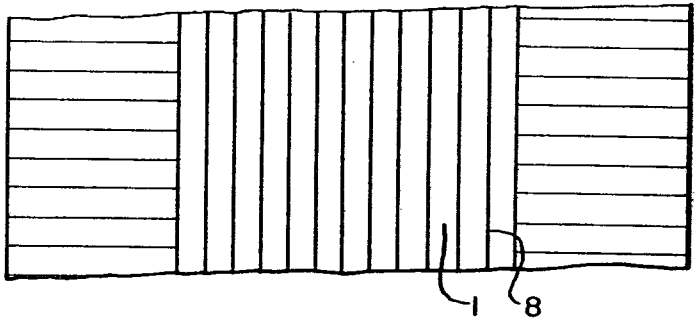
FIG. 4 shows a top view of the float deck, in which the transfer track can be seen without the carrier wagon.
Figure 3:
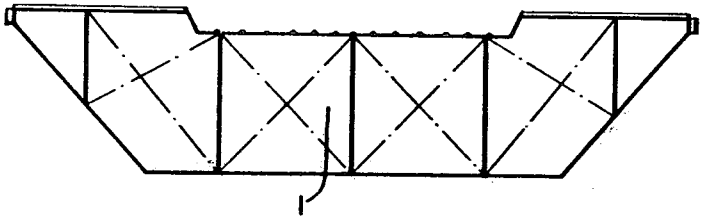
FIG. 3 shows a cross-section of the float, according to the A—A line in FIG. 1.
Figure 2:
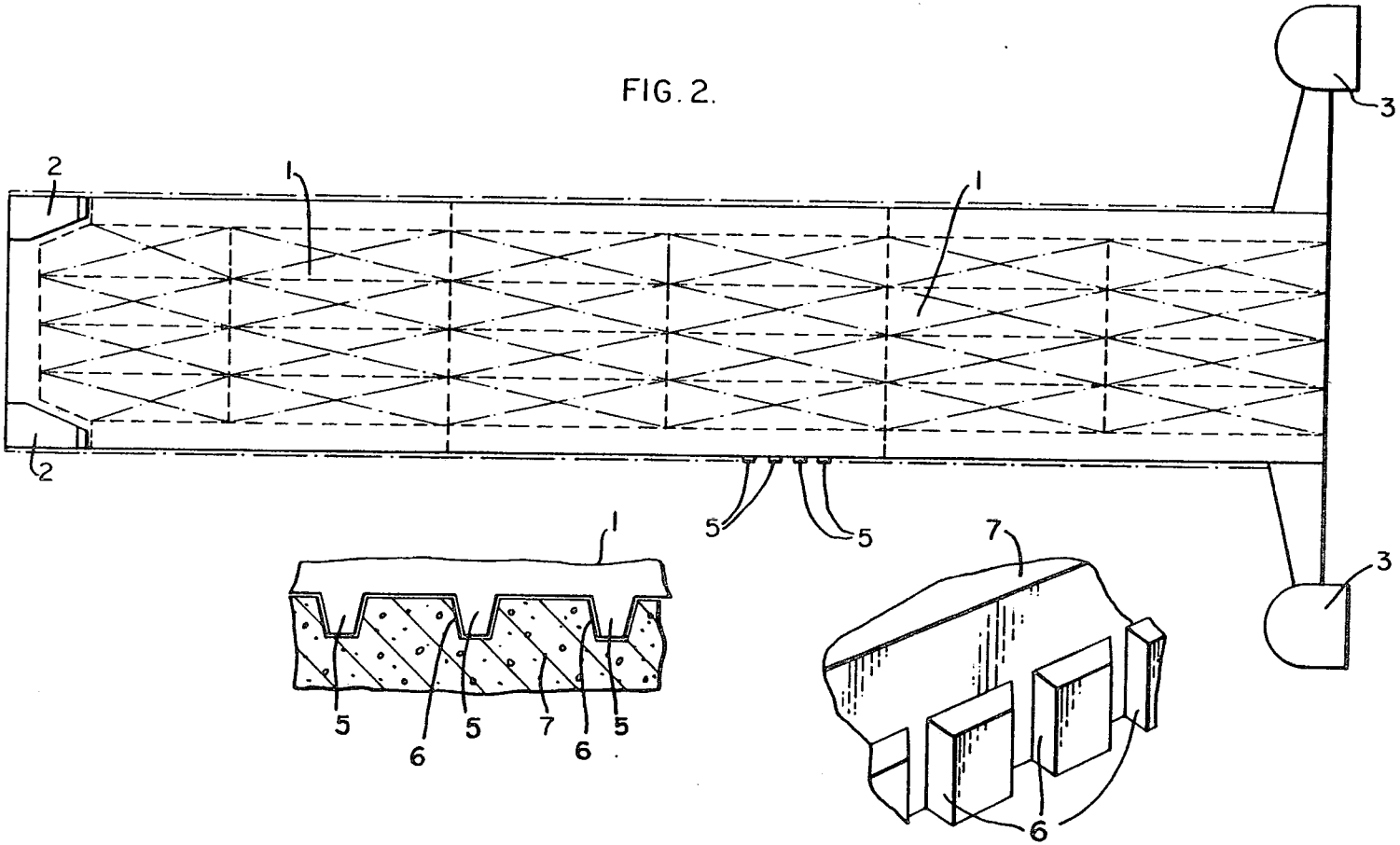
FIG. 2 shows a plan view of the same float, with details on a larger scale of its boards corresponding to the dock walls.

Referring now to FIG. 2, the present invention comprises a main float body 1 having a series of tanks which are flooded or bailed out in the same way as is a conventional floating dock. The transverse strength problem of the structure is advantageously solved by incorporating breast shores larger than those used in bottom boxes of conventional floating docks. Suitable tank arrangement enables moderate bending moment values and consequently normal dimension to be obtained with a steel weight of the suitable structure.

With moderate values of the bending moment and shearing stress in the main float body 1, bow towers 2 and aft towers 3 advantageously provide suitable stability both in floating and drydocking operations, without any obstruction existing which prevents the ship from being placed on the main body of the float. Movement of the ship from its stranded position both in a transverse and longitudinal direction is unobstructed.

Figure 8:
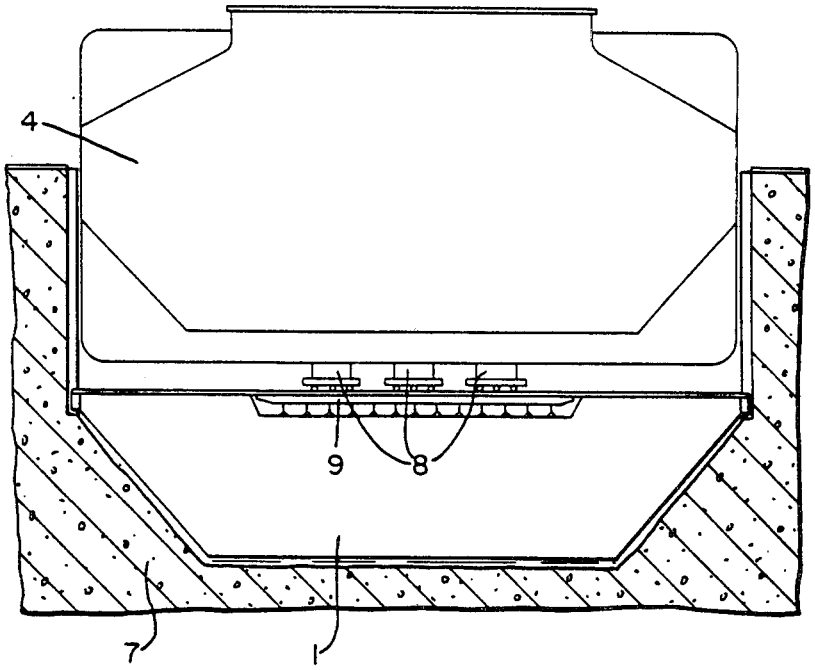
FIG. 8 shows a vertical cross-section depicting a vessel in the dock on the float in the lifting stage.
Figure 9:
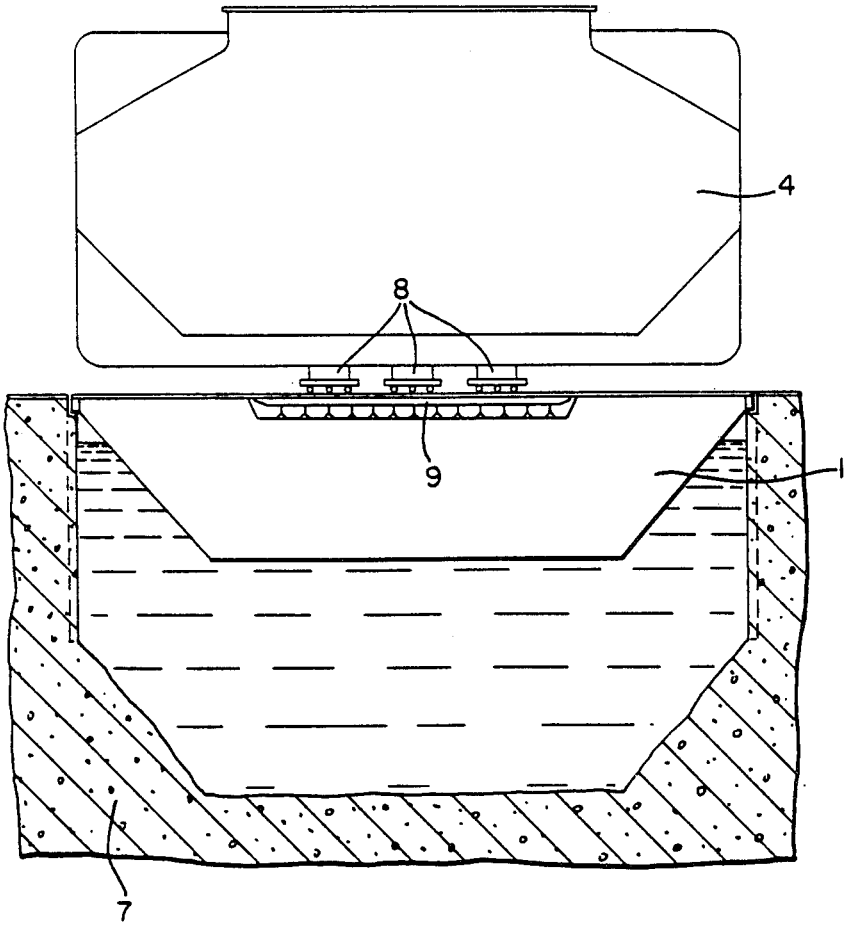
FIG. 9 shows the moment in which the float reaches the wharf level with the dry dock.
Figure 10:
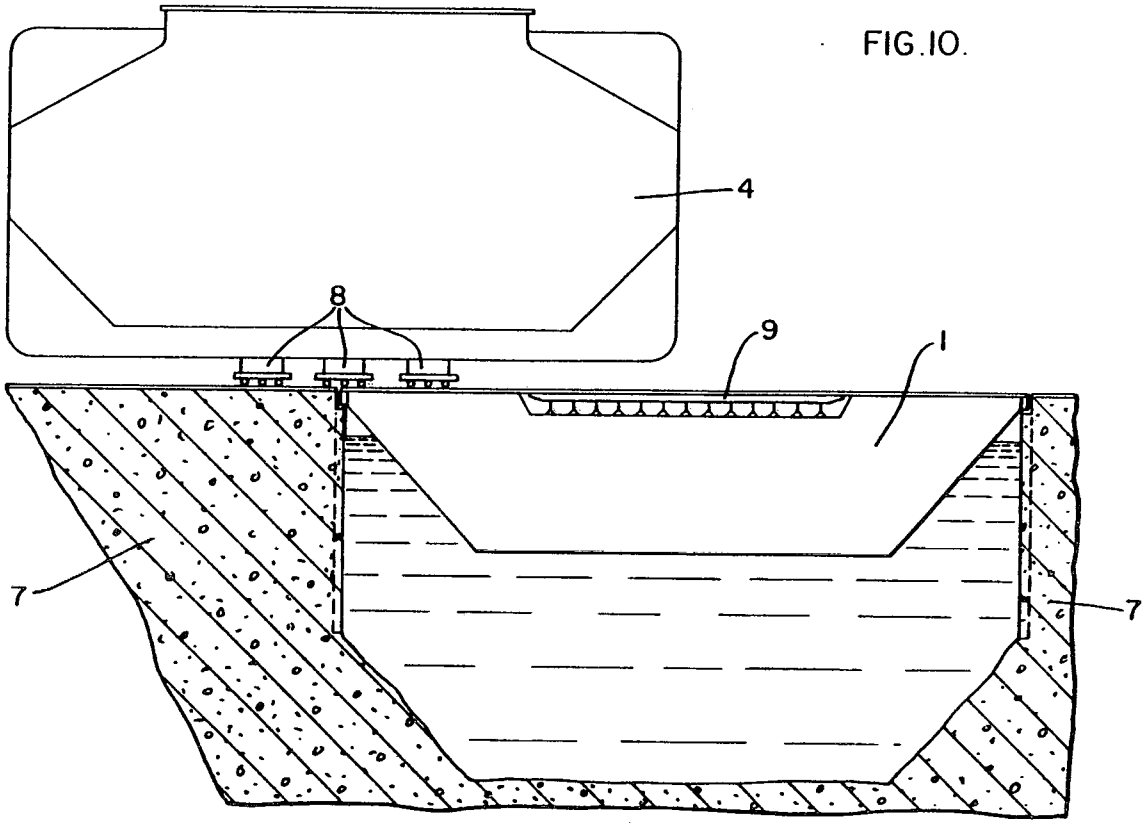
FIG. 10 shows side transfer of a vessel using the breadth tracks and leaving the main carrier wagon anchored in the float.
Figure 11:
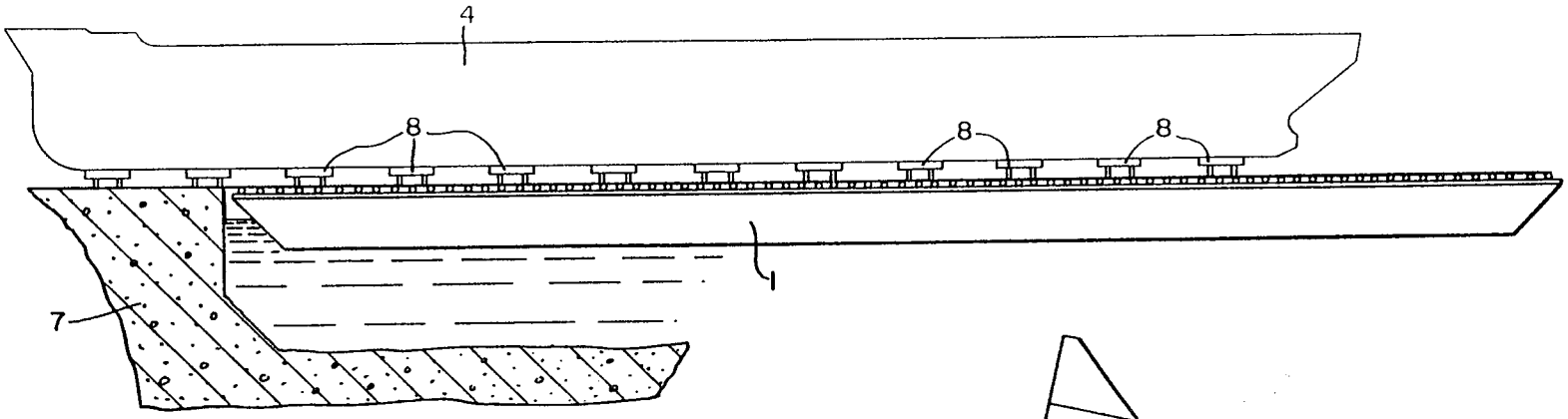
FIG. 11 is a longitudinal cross-section showing longitudinal transfer of a vessel by means of the carrier wagon.

The method of operation of the present invention is depicted in FIGS. 8–11. In FIG. 8 the body of the main float 1 and the aft towers are flooded so that float 1 is in its lowest position. Ship 4 enters the dock and is placed over the float 1. The tanks of main float 1 are then bailed out (we shall refer later to the variations). The aft towers 3 are fixed to main float 1 and are arranged sufficiently far from the center line of main float 1 and with a suitable volume so that with the bow towers 2, both transverse and longitudinal stability of the unit of main float 1 and ship 4 is obtained. The main float body 1 and ship 4 are raised by bailing out the tanks of the main float body 1. During the rising operation, as the tanks of the float body 1 are bailed out, the aft towers 3 which are flooded with water are also bailed so that the outside water level coincides with the water level inside the aft tower. The water level is controlled with conventional regulating techniques which allow approximate setting of the water level.

The use of aft towers 3 which can be flooded and bailed advantageously minimizes bending moments which could otherwise produce structural failure. The bow towers 2 have a much smaller cross-section than the aft towers 3 and are placed in a prow position of the float 1 where they do not prevent drydocking ships, taking into account that the ships have their slender shapes in their bow part. The bow towers 2 are not flooded with water because their thrust is small and they are placed relatively near the center line of the float. Thus the bending moments created by bow towers 2 are absorbed by the structure.

The sides of the float have a plurality of protruding pegs or supports 5 which are fitted within vertical channels 6 defined in the walls of the wharf 7. Once main float 1 has risen to the surface and reached its "service floatation", the float unit is displaced slightly about 600 mm. A few millimeters of water are bailed out of the tanks so that the aforementioned supports 5 come to rest on the horizontal base of the wharf 7, between each adjacent pair of vertical channels 6. The unit comprising main float 1 and vessel 4 now rests on the walls of the wharf 7. However, the walls of the wharf 7 bear only an extremely small load since main float 1 withstands the weight of the ship. This support system prevents float 1 from moving while the ship is being transferred to land.

Figure 5:
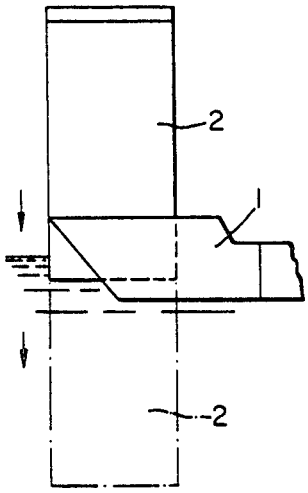
FIG. 5 is a detailed side cross-section of the bow stabilizer, according to the B—B line in FIG. 1.
Figure 7:
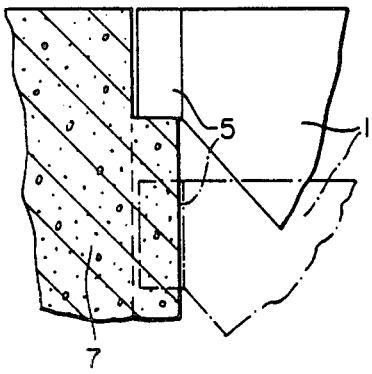
FIG. 7 is a detail on a larger scale of the side support of the float on the side of the wharf, with a view to the two stages.

Bow towers 2 together with aft towers 3 provide transverse and longitudinal stability. The bow towers 2 are kept empty of water. Furthermore, the bow towers 2 can be displaced in a vertical direction to facilitate the unhindered transfer of vessels to land. The bow tower may be flooded through use of a hand valve. As the bow tower sinks, it is guided by the tower 2, so that the bow tower submerges under the float deck, thus providing an obstacle-free surface across which the ship can leave (FIG. 5).

The vessel is transferred to land through use of longitudinal and transverse wheels 8 and 9 similar to those used in conventional systems. However, the present invention advantageously allows for transverse displacement of the vessel so that the vessel may be transversely moved from the main float to the wharf, thus effecting a considerable saving in space and time.

Floatation of a vessel is performed in an opposite way to that described above. The float 1 is supported on the wharf walls and the vessel is rolled onto the main float. Once in position, compressed air is inserted into the bow towers 2, bailing out the water and causing towers 2 to automatically rise. Bow towers 2 are fixed to the deck by means of a simple hydraulic system. However, no fixing whatever is necessary, since the thrust of the tower, when the float lowers, will fix bow tower 2 against the deck. The lowering operation commences by simultaneously filling the tanks of the float 1 and the aft towers 3. The inner water level of the aft towers 3 is maintained at a predetermined differential level.

Once the ship 4 has reached a normal level, it is left floating and is withdrawn by standard towing means.

Flooding and bailing out of the tanks can be performed by means of water pumps or by compressed air, although the use of pumps is preferred. However, unlike floating docks, the pumps are installed in a pumping shaft on land 7 and connected to the tanks of the float and stern towers 3, by means of hoses. The valves are closed and opened by remote control hydraulic or pneumatic systems, according to conventional techniques.

Conventional floating dock systems are used for controlling the transverse and longitudinal tilt, as well as bending and loads in the float structure. Illustrative systems are those approved by vessel classification companies.

The transverse shape of the float can take a variety of alternative forms from that shown in the figures. For example, the shape can be approximately rectangular in cross-section. It should be understood that the shape depends basically on the lifting power, the beam of the vessels and especially on the variation in tides and the relative level of the shipyard with respect to the average sea level in the area.

Figure 6:
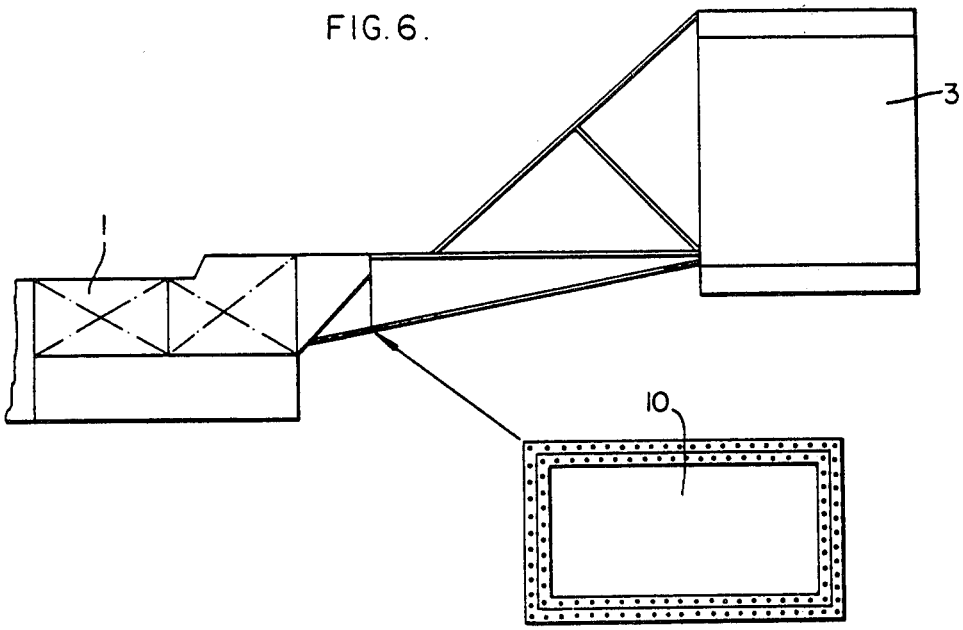
FIG. 6 is a partial detail of an aft stabilizer, according to the C—C line in FIG. 1, with a view to the link joint.
Figure 12:
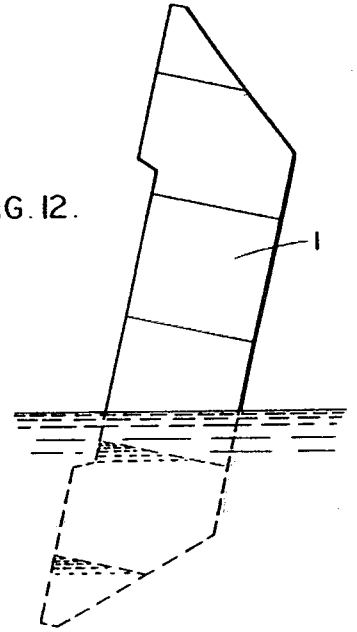
FIG. 12 shows side lifting of the float for cleaning bottoms and and sides.

The self docking feature of the float advantageously makes stripping of bow towers 2 extremely easy since after all the water is bailed out of the ballast tanks, bow towers 2 automatically come out of their guide. To strip aft towers 3, there is provided a joint 10, screwed in as shown in FIG. 6. The screws are removed, leaving main float 1 free from aft towers 3, with sufficient stability. The tanks of one band are then flooded until the keel is uncovered and it is then careened (see FIG. 12.)

I claim:

1. A self-stabilized float adapted for use with a wharf for dry docking or floating a vessel on a body of fluid and permitting the transfer of the vessel between the body of fluid and the wharf via the float, in the longitudinal and transverse directions of the float, said float comprising:

a main body having at least one ballast tank, a first pair of hollow, closed towers at one end of said body, supporting means extending laterally from said main body, for securing said towers thereto so as to be laterally offset therefrom, a second pair of hollow, closed towers at the other end of said body spaced substantially closer together than said first pair of towers and mounted for vertical displacement with respect to said main body, said first and second pairs of towers serving to impart transverse and longitudinal stability to said float, means for alternatively bailing and flooding said at least one tank to raise or lower said body, said means also bailing and flooding said first pair of towers to maintain the level of fluid therein approximately at the same level as said body of fluid thereby relieving stresses on said supporting means, said second pair of towers being normally free of fluid, and means for selectively flooding and bailing said second pair of towers to lower and raise the same with respect to said main body.

2. The float of claim 1 wherein said bailing and flooding means comprises at least one pump means.

3. The float of claim 1 wherein said bailing and flooding means comprises at least one air compressor means.

4. The float of claim 1 further comprising at least one hose for communicating said at least one ballast tank with said means for bailing and flooding located onshore.

5. The float of claim 1 further comprising a plurality of protruding pegs affixed along the sides of said body and adapted to slidably fit within vertical channels defined in the walls of an adjacent wharf for engaging the wall of said wharf interjacent said channels upon flotation and slight displacement of said body to impart stability to said body.

6. The float of claim 1 further comprising first truck means for transferring vessels longitudinally across said body onto the wharf and second truck means for transferring vessels transversely across said body onto said wharf.

7. The float of claim 6 wherein one of said truck means is arranged above the other said truck means on the deck of said body.

8. The float of claim 1 wherein said first and second pairs of towers are detachably affixed to said main body to allow careening of said main body.

* * * * *